US008231422B2

(12) United States Patent
Kifune et al.

(10) Patent No.: US 8,231,422 B2
(45) Date of Patent: Jul. 31, 2012

(54) PLASMA DISPLAY PANEL AND MANUFACTURING METHOD THEREOF

(75) Inventors: Motonari Kifune, Miyazaki (JP); Masashi Nishiki, Miyazaki (JP); Akira Shimoyoshi, Miyazaki (JP)

(73) Assignee: Hitachi, Ltd., Tokyo (JP)

( * ) Notice: Subject to any disclaimer, the term of this patent is extended or adjusted under 35 U.S.C. 154(b) by 346 days.

(21) Appl. No.: 11/714,166

(22) Filed: Mar. 6, 2007

(65) Prior Publication Data

US 2007/0262716 A1 Nov. 15, 2007

(30) Foreign Application Priority Data

May 15, 2006 (JP) ..... 2006-135357

(51) Int. Cl.
*H01J 61/30* (2006.01)
*H01J 61/35* (2006.01)

(52) U.S. Cl. ..... 445/24; 313/581; 313/582; 313/583; 445/23

(58) Field of Classification Search ..... 313/581–604; 445/23–25
See application file for complete search history.

(56) References Cited

U.S. PATENT DOCUMENTS

| | | | | |
|---|---|---|---|---|
| 5,977,708 | A | 11/1999 | Amatsu et al. | |
| 6,160,345 | A | 12/2000 | Tanaka et al. | |
| 6,670,754 | B1 * | 12/2003 | Murai et al. | 313/582 |
| 2002/0014841 | A1 * | 2/2002 | Nishiki et al. | 313/587 |
| 2004/0138045 | A1 | 7/2004 | Komatsudani et al. | |
| 2005/0242725 | A1 * | 11/2005 | Hasegawa et al. | 313/582 |

FOREIGN PATENT DOCUMENTS

| | | | |
|---|---|---|---|
| CN | 1200554 | A | 12/1998 |
| CN | 1495143 | A | 5/2004 |
| CN | 1701410 | A | 11/2005 |
| JP | 2001151532 | A * | 6/2001 |
| JP | 2003-45322 | | 2/2003 |
| JP | 2005-149937 | | 6/2005 |
| JP | 2006-114520 | | 4/2006 |
| WO | WO 2004/053915 | A1 | 6/2004 |

OTHER PUBLICATIONS

Communication mailed from the Chinese Patent Office on Mar. 20, 2009 in the corresponding Chinese patent application.

* cited by examiner

*Primary Examiner* — Joseph L Williams
*Assistant Examiner* — Nathaniel Lee
(74) *Attorney, Agent, or Firm* — Staas & Halsey LLP

(57) ABSTRACT

A plasma display panel includes a substrate, a plurality of metal electrodes, and a dielectric layer. The plurality of metal electrodes are formed on the substrate in a predetermined direction. The dielectric layer is formed on the metal electrodes by firing a glass material. The metal electrodes are formed with a film thickness of 6 μm or less. The dielectric layer is formed with a film thickness of 25 μm or less.

4 Claims, 4 Drawing Sheets

| | CLASSIFICATION OF BUBBLE SIZES | |
|---|---|---|
| DIELECTRIC FILM THICKNESS ($\mu$m) | $\phi$5 TO 10$\mu$m (NUMBER) | $\phi$10$\mu$m OR MORE (NUMBER) |
| 10 | 0 | 0 |
| 20 | 2 | 0 |
| 25 | 10 | 3 |
| 35 | 58 | 7 |
| 45 | 51 | 16 |

PLASMA DISPLAY PANEL AND MANUFACTURING METHOD THEREOF

CROSS-REFERENCE TO RELATED APPLICATION

This application is related to Japanese application No. 2006-135357 filed on May 15, 2006 whose priority is claimed under 35 USC §119, the disclosure of which is incorporated by reference in its entirety.

BACKGROUND OF THE INVENTION

1. Field of the Invention

This invention relates to a structure and a manufacturing method of a plasma display panel (hereinafter, referred to as "PDP"), and more particularly, relates to a structure and a manufacturing method of a PDP that causes no bubbles in a dielectric layer of a glass material used for covering metal electrodes.

2. Description of the Related Art

An AC drive three-electrode face discharge type PDP has been known as a conventional PDP. This PDP has a structure in which a number of display electrodes capable of face discharging are placed in a horizontal direction on the inner face of a substrate on the front face side, and a number of address electrodes used for selecting a light-emitting cell are placed on the inner face of a substrate on the back face side, with an intersection between each display electrode and each address electrode serving as one cell (unit light-emitting area). One pixel is constituted by three cells, that is, a red color (R) cell, a green color (G) cell and a blue color (B) cell.

The substrate on the front face side and the substrate on the back face side, thus formed, are placed face to face with each other with the peripheral portion being sealed, and the inside thereof is then filled with a discharge gas so that the PDP is manufactured.

In the above-mentioned PDP, upon forming the substrate on the front face side, a plurality of display electrodes are formed on a glass substrate. These display electrodes are normally constituted by transparent electrodes and metal electrodes.

The transparent electrodes are formed by film-forming ITO, $SnO_2$ or the like on the substrate and by patterning the resulting film.

The metal electrodes are used for reducing the wiring resistance of the electrodes, and also referred to as bus electrodes. The metal electrodes are formed as metal electrodes having a three-layer structure through processes in which metal films of three layers of Cr—Cu—Cr are formed on the transparent electrodes and the resulting films are patterned. Alternatively, a silver paste is applied onto the transparent electrodes and then subjected to a firing process so that the metal electrodes are formed.

After the display electrodes have been formed in this manner, a dielectric layer is formed on the display electrodes, and a protective layer is then formed thereon.

Upon forming the substrate on the back face side, address electrodes made of metal are formed on a glass substrate in a direction crossing the display electrodes, and a dielectric layer is formed thereon, with barrier ribs being formed thereon, and a phosphor layer is then formed in an elongated recess groove between the barrier ribs.

With respect to the material for the dielectric layer, normally, a low-melting-point glass containing lead is normally used because of its easiness in processability (see Japanese Unexamined Patent Publication No. Hei 6(1994)-33503).

In recent years, however, non-lead structures for domestic electric appliances have been developed so as to reduce the environmental load, and in the field of the PDPs also, there have been strong demands for non-lead materials.

However, in the case when a dielectric layer is formed by placing a glass material and firing the material, upon application of a non-lead-based material as the glass material, the glass softening point becomes higher, causing degradation in the glass flowability upon firing the glass material. As a result, bubbles, generated from the glass material during the firing process due to an electrochemical reaction between the metal electrodes and glass, are hardly released during the firing process to remain in the dielectric layer. Product defects, such as an insufficient insulation and a reduction in luminescence due to degradation in the light transmitting property, are caused by the influence of these remaining bubbles (voids).

SUMMARY OF THE INVENTION

The present invention has been devised so as to solve the above-mentioned problems, and upon placing a glass material on metal electrodes and carrying out a firing process so that a dielectric layer is formed, by taking the thickness of the electrodes and the thickness of the dielectric layer into consideration, the generation of bubbles due to a reaction between the metal electrodes and glass is restrained to prevent bubbles from remaining in the dielectric layer; thus, even a non-lead-based glass material can be used upon forming the dielectric layer, and it becomes possible to improve performances of the manufactured panel.

The present invention provides a plasma display panel that is provided with a substrate, a plurality of metal electrodes formed on the substrate in a predetermined direction and a dielectric layer that is formed on the metal electrodes by firing a glass material, and in this structure, the metal electrodes are formed with a film thickness of 6 μm or less, and the dielectric layer is formed with a film thickness of 25 μm or less.

In accordance with the present invention, since it becomes possible to prevent bubbles from remaining in the dielectric layer, product defects such as an insufficient insulation and a reduction in luminescence can be prevented. Moreover, it becomes possible to apply even a non-lead-based material to the dielectric layer.

DETAILED DESCRIPTION OF THE INVENTION

Figure 1:
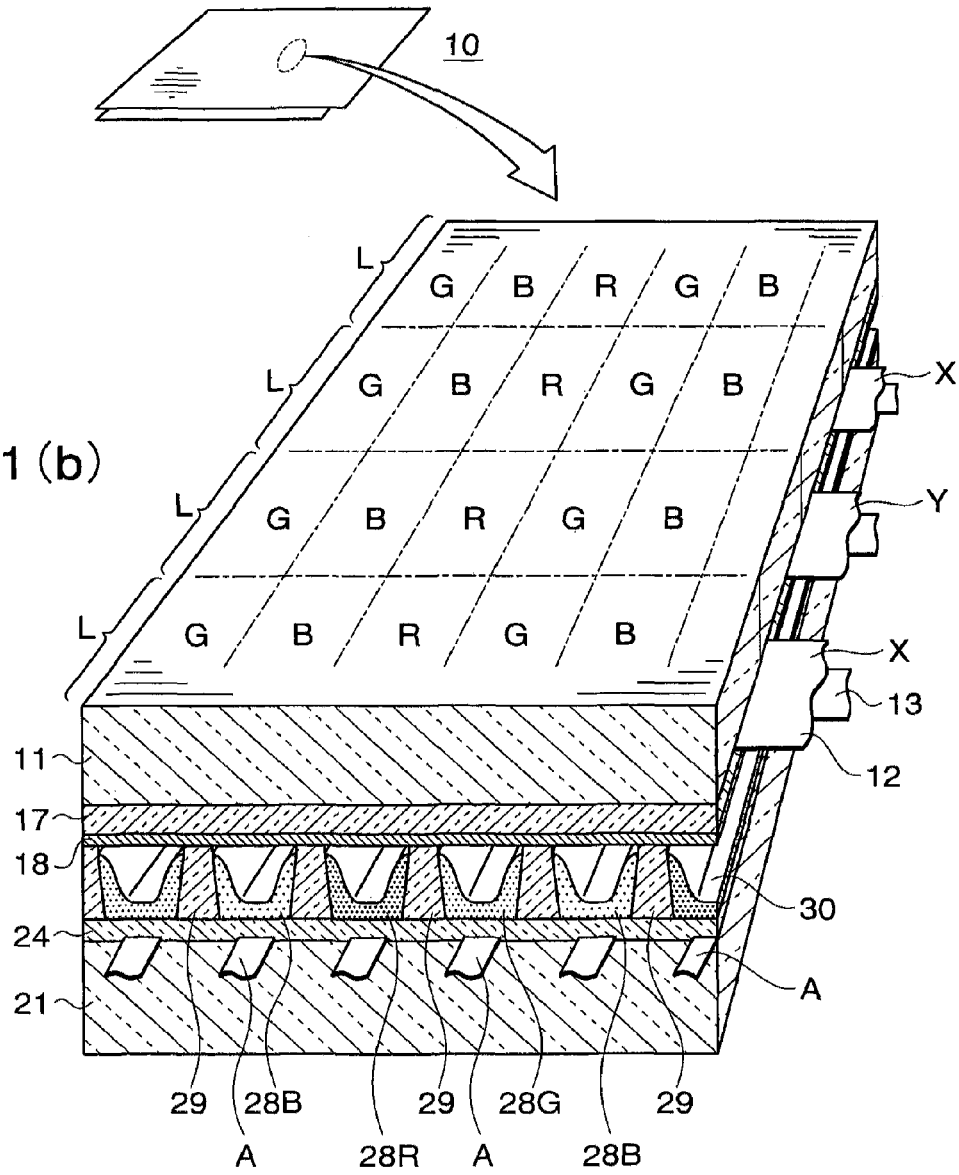
FIG. 1 is an explanatory diagram that shows a structure in an embodiment of a PDP manufactured by a manufacturing method of the present invention.

In the present invention, examples of the substrate include substrates of materials such as glass, quartz and ceramics, as well as any of these substrates on which a desired structure such as electrodes, an insulating film, a dielectric layer, a protective film and the like are formed.

A plurality of metal electrodes may be formed on the substrate in a predetermined direction. These metal electrodes can be formed by using various known materials through known methods in the corresponding field. With respect to the materials used for the electrodes, examples thereof include metal conductive materials such as Ag, Au, Al, Cu and Cr. With respect to the forming method of the electrodes, various conventionally known methods in the corresponding field may be used. For example, a thick-film forming technique such as printing may be used to form the electrodes, or a thin-film forming technique corresponding to a physical deposition method or a chemical deposition method may be used. As an example of the thick-film forming technique, a screen printing method is used. Examples of the physical deposition method as the thin-film forming technique include a vapor deposition method, a sputtering method and the like. Examples of the chemical deposition method include a thermal CVD method, a photo CVD method and a plasma CVD method.

The dielectric layer may be formed through processes in which a glass material is placed on a metal electrode and this is then fired. This dielectric layer is formed by applying a glass paste made from non-lead-type glass frit (glass powder), a binder resin and a solvent onto a substrate in a manner so as to cover the metal electrodes through a screen printing method, or by affixing a green sheet (un-sintered dielectric sheet) of non-lead-type glass powder thereto and firing the resulting substrate. Examples of glass materials used as the non-lead-type glass frit include $B_2O_3$—$SiO_2$—ZnO-based glass, $Bi_2O_3$—$B_2O_3$—$SiO_2$-based glass, $B_2O_3$—$SiO_2$—$Al_2O_3$-based glass, ZnO—$B_2O_3$—$SiO_2$—BaO-based glass, and any of the foregoing glass materials mixed with an alkali or alkali-earth oxide.

In the present invention, the dielectric layer may be formed by laminating a plurality of dielectric layers into, for example, double layers and triple layers. For example, in the case of forming the dielectric layer with a double layer structure, a first dielectric layer is formed with a film thickness of 12 μm or less and a second dielectric layer may be formed thereon with a film thickness of 13 μm or less.

The metal electrodes may be such that a Cr layer is formed on a substrate, a Cu layer is formed thereon, and a Cr layer is further formed thereon respectively through a vapor film-forming method, and a resist film is formed on the metal film with the three layers, and after having patterned the resist film by using a photolithographic technique, the metal film on unnecessary portions are removed by etching so that a metal electrode having a three-layer-structure of Cr—Cu—Cr is prepared.

The invention is explained in detail by the following embodiments with reference to the drawings. However, the present invention is not intended to be limited thereby, and various modifications may be made therein.

FIGS. 1(*a*) and 1(*b*) are explanatory diagrams that show a structure of a PDP manufactured by a manufacturing method of the present invention. FIG. 1(*a*) shows the entire structure of the PDP, and FIG. 1(*b*) is a partially exploded perspective view of the PDP. This PDP is a three-electrode face discharge type PDP of an AC drive type for color display.

The PDP 10 is constituted by a substrate 11 on the front face side on which constituent elements that provide functions as the PDP are formed and a substrate 21 on the back face side. With respect to the substrate 11 on the front face side and the substrate 21 on the back face side, for example, a glass substrate, a quartz substrate and a ceramics substrate may be used.

Display electrodes X and display electrodes Y are placed with equal intervals in the horizontal direction on the inner side face of the substrate 11 on the front face side. All the gaps between the adjacent display electrodes X and display electrodes Y form display lines L. Each of the display electrodes X and Y is constituted by a transparent electrode 12 with a wide width, made of ITO, $SnO_2$ or the like, and a bus electrode 13 with a narrow width, made of metal, such as Ag, Au, Al, Cu, Cr or a laminated body thereof (for example, Cr—Cu—Cr laminated structure), or the like. With respect to the display electrodes X and Y, in the case of Ag and Au, a thick-film forming technique such as screen printing may be used, and in the case of other materials, a thin-film forming technique such as a vapor method and a sputtering method and an etching technique may be used, so that the display electrodes having a desired number, thickness, width and intervals are formed.

The display electrodes X and Y may be made of only metal, such as Ag, Au, Al, Cu, Cr or a laminated body thereof. In such a case, preferably, the form of the metal electrode has a line pattern or a mesh pattern so that light from phosphor layers is effectively transmitted.

Here, in the present PDP, a PDP having a so-called ALIS structure, in which the display electrodes X and the display electrodes Y are placed with equal intervals, with all the gaps between the adjacent display electrodes X and display electrodes Y forming display lines L, is shown. However, the present invention may be applied even to a PDP having a structure in which paired display electrodes X and Y are placed with a gap (non-discharging gap) causing no discharge.

A dielectric layer 17 is formed on the display electrodes X and Y in a manner so as to cover the display electrodes X and Y. The dielectric layer 17 is formed by applying a glass paste made from non-lead-type glass frit, a binder resin and a solvent onto a substrate 11 on the front face side through a screen printing method and by firing the resulting substrate.

A protective layer 18 used for protecting the dielectric layer 17 from damage caused by collision of ions generated by a discharge upon displaying is formed on the dielectric layer 17. This protective film is made from MgO. The protective layer may be formed by using a known thin-film forming process in the corresponding field, such as an electron beam vapor deposition method and a sputtering method.

A plurality of address electrodes A are formed on the inner side face of the substrate 21 on the back face side in a direction crossing the display electrodes X and Y when viewed from above, and a dielectric layer 24 is formed so as to cover the address electrodes A. Each of the address electrodes A is used for generating an address discharge so as to select a light-emitting cell at an intersection with the Y electrode, and formed into a three-layer structure of Cr—Cu—Cr. The address electrodes A may be formed by using another material such as Ag, Au, Al, Cu, or Cr. In the same manner as the display electrodes X and Y, with respect to the address electrodes A, in the case of Ag and Au, a thick-film forming technique such as screen printing may be used, and in the case of the other materials, a thin-film forming technique such as a vapor method and a sputtering method and an etching technique may be used, so that the address electrodes having a desired number, thickness, width and intervals are formed. The dielectric layer 24 may be formed by using the same material and the same method as the dielectric layer 17.

A plurality of barrier ribs 29 having a stripe pattern are formed on the dielectric layer 24 between the adjacent address electrodes A. With respect to the shape of the barrier ribs 29, not limited to this shape, a mesh shape (box shape) in which discharge spaces are separated for each cell may be used. The barrier ribs 29 may be formed by using a method such as a sand blasting method, a printing method and a photo-etching method. For example, in the sand blasting method, after a glass paste, made from low-melting-point glass frit, a binder resin, a solvent and the like, have been applied to the dielectric layer 24 and dried thereon, cutting particles are blown onto the glass paste layer with a cutting mask having openings of the barrier rib pattern attached thereon, so that the glass paste layer exposed to the openings of the mask is cut; thus, the resulting layer is fired to form the barrier ribs. Moreover, in the photo-etching method, instead of cutting by the use of cutting particles, a photosensitive resin is used as the binder resin, and after exposing and developing processes by using a mask, the resulting layer is fired to firm the barrier ribs.

Phosphor layers of 28R, 28G and 28B having respective red (R), green (G) and blue (B) colors are formed on side faces and a bottom face of each of discharge spaces having a recess groove shape between the barrier ribs 29. Each of the phosphor layers 28R, 28G and 28B is formed through processes in which: a phosphor paste containing phosphor powder, a binder resin and a solvent has been applied to the discharge space having the recess groove shape between the barrier ribs 29 by using a screen printing method or a method using a dispenser, and after repeating this process for each of the colors, the resulting layers are fired. These phosphor layers 28R, 28G and 28B may also be formed through a photolithographic technique by using a sheet-shaped phosphor layer material (so-called green sheet) containing phosphor powder, a photosensitive material and a binder resin. In this case, a sheet having a desired color is affixed to the entire face of a display area on the substrate, and this is exposed and developed, and by repeating these processes for each of the colors, the phosphor layers of the respective colors are formed on the corresponding gaps between the barrier ribs.

The substrate 11 on the front face side on which these constituent elements have been formed and the substrate 21 on the back face side are placed face to face with each other so that the display electrodes X and Y cross the address electrodes A, and the peripheral portion is sealed so that a discharge space 30 surrounded by the barrier ribs 29 is filled with a discharge gas in which Xe, Ne and the like are mixed; thus, a PDP is manufactured. In this PDP, the discharge space 30, located each of the intersections between the display electrodes X and Y and the address electrodes A, forms one cell (unit light-emitting area) that is the minimum unit for display. One pixel is constituted by three cells of R, G and B.

Figure 2:
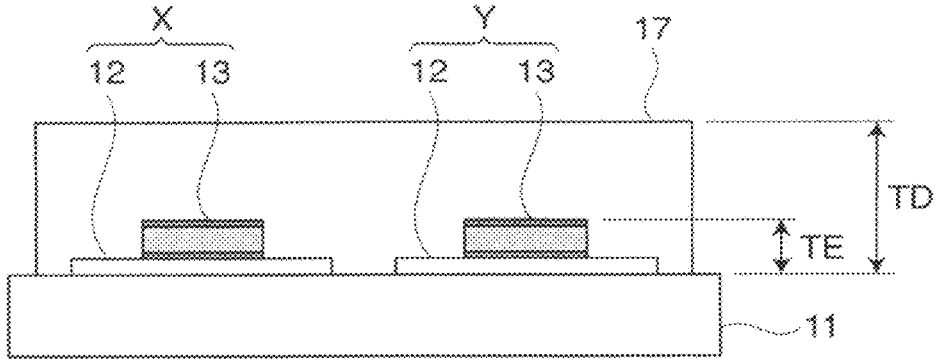
FIG. 2 is a partial cross-sectional view that shows a substrate on the front face side in accordance with an embodiment of the present invention.

FIG. 2 is a partial cross-sectional view showing a substrate on the front face side.

The display electrodes X and Y are formed on the glass substrate 11 on the front face side. The display electrodes X (X electrodes) and the display electrodes Y (Y electrodes) have the same structure, that is, the structure in which bus electrodes 12 made of metal are formed on a transparent electrode 11.

The transparent electrode 12 is formed with a film thickness in a range from 500 to 2000 Å. The bus electrode 13 has a three-layer structure of Cr—Cu—Cr in which Cr has a film thickness in a range from 500 to 2000 Å, with Cu being formed with a thickness of about 3 μm. Therefore, the thickness TE of each of the display electrodes X and Y is in an approximate range from 3 to 4 μm. A dielectric layer 17 is formed on the display electrodes X and Y. The thickness TD of the dielectric layer 17 is about 20 μm.

Figure 3:
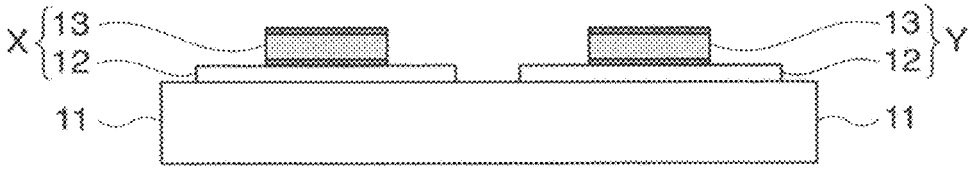
FIG. 3 is an explanatory diagram that shows a first example of a manufacturing method for a substrate on the front face side in accordance with an embodiment of the present invention.
Figure 3:
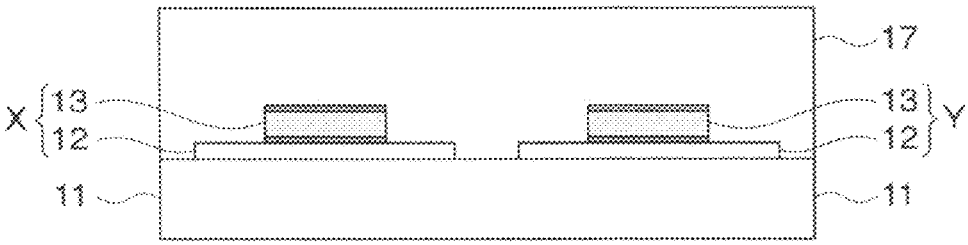

FIGS. 3(*a*) and 3(*b*) are explanatory diagrams showing a first example of a manufacturing method of the substrate on the front face side.

The substrate on the front face side is manufactured in the following processes. First, a transparent conductive film, made of ITO, is formed on a glass substrate 11 by a method, such as a vapor deposition method and a sputtering method, and the transparent conductive film is patterned by using a photolithographic technique to prepare a transparent electrode 12. Then, a three-layer metal conductive film of Cr—Cu—Cr is formed on the transparent electrode 12 by using a method such as a vapor deposition method and a sputtering method, and a resist film is formed on the metal conductive film, and after the resist film has been patterned by using the photolithographic technique, unnecessary portions of the metal conductive film are removed by etching so that bus electrodes 13 are formed. In this manner, the display electrodes X and the display electrodes Y are simultaneously formed (see FIG. 3(*a*)). Each of the display electrodes X and Y is formed with a thickness of 6 μn or less. The film thickness of the Cu portion of the bus electrode 13 is set to 3 to 4 μm.

Next, a glass paste (glass material), prepared by mixing a binder resin and a solvent with non-lead-based glass frit, is applied onto the glass substrate 11 so as to cover the display electrodes X and Y by using a screen printing method, and after this has been dried into a dried film, the glass substrate 11 is loaded into a firing furnace, and the dried film of the glass material is fired at a temperature in a range from 600 to 610° C. so that a dielectric film 17 is formed (see FIG. 3(*b*)). The dielectric layer 17 is formed with a thickness of about 20 μm.

Besides this method, the dielectric layer 17 may be formed by affixing a green sheet (un-sintered dielectric sheet) with which non-lead-based glass powder is mixed to the substrate 11 on the front face side, and by firing the resulting substrate.

As the non-lead-based glass frit, one of the following is used: $B_2O_3$—$SiO_2$—ZnO-based glass, $Bi_2O_3$—$B_2O_3$—$SiO_2$-based glass, $B_2O_3$—$SiO_2$—$Al_2O_3$-based glass, ZnO—$B_2O_3$—$SiO_2$—BaO-based glass, and any of the foregoing glass materials mixed with an alkali or alkali-earth oxide.

When the dried film of the glass material is fired, the glass material is fused. At this time, bubbles are generated in the glass material by an electrochemical reaction between the glass material and the bus electrodes 13 of metal. The generation of these bubbles is mainly caused by a chemical reaction between Cu and glass. Here, Cu is not directly made in contact with the glass material because it is sandwiched by Cr. However, in the case when the three-layer metal conductive film of Cr—Cu—Cr is etched by a wet-etching process or the like, Cu is exposed between Cr and Cr, and the exposed Cu comes into contact with the glass material to cause a reaction, with the result that bubbles are generated in the glass material.

In order to reduce the generation of these bubbles, the thickness of the bus electrode 13 that is a generation source of bubbles is made thinner. In particular, the thickness of Cu is made thinner. More specifically, as described earlier, the thickness of the bus electrode 13 is set to 6 μm or less, with the thickness of Cu being set to 3 to 4 μm.

Conventionally, low-melting point glass frit containing lead has been usually used as the glass material for the dielectric layer. In contrast, in recent years, from the viewpoint of reducing the environmental load, an attempt to use a non-lead-based glass material has been made. In the application of the non-lead-based glass material, however, the melting point (glass softening point) of the glass material becomes higher. For this reason, upon firing, the flowability in the glass deteriorates, making it difficult to release bubbles generated in the glass material when fired, to cause the bubbles to remain in the dielectric layer.

In order to easily release bubbles in the glass material, the film thickness of the dielectric layer 17 is made thinner. More specifically, as described above, the film thickness of the dielectric layer is set to 25 μm or less. With this arrangement, even when the flowability of the glass material is lowered because of the use of the non-lead-based glass material, generated bubbles are allowed to float and easily defoamed so that the bubbles in the dielectric layer 17 are reduced upon completion of the firing process.

In this manner, the thickness of the electrodes is made thinner to reduce the absolute amount of bubbles that are generated and the film thickness of the dielectric layer is also made thinner so as to easily release bubbles in the glass material so that bubbles in the dielectric layer 17 are reduced upon completion of the firing process. By reducing the bubbles in the dielectric layer 17, it becomes possible to prevent problems such as an insufficient insulation and a reduction in luminescence.

Here, the discharge voltage between the display electrodes relates to the film thickness of the dielectric layer. Moreover, the film thickness of the dielectric layer relates to the static capacitance of the dielectric layer. Furthermore, the static capacitance of the dielectric layer relates to the quantity of discharge between the display electrodes. Therefore, in an attempt to obtain an appropriate quantity of discharge by applying an appropriate discharge voltage across the display electrodes, the dielectric layer is preferably made so as to accumulate a charge of 0.2 nF or more per 1 $cm^2$ thereof, in the case when the film thickness of the dielectric layer is set to 25 μm or less.

Figure 4:
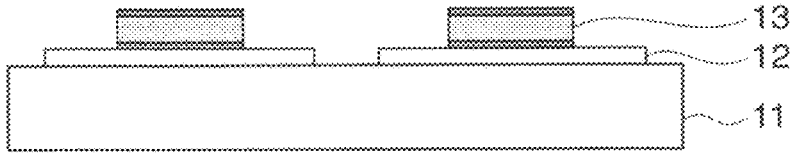
FIG. 4 is an explanatory diagram that shows a second example of the manufacturing method for the substrate on the front face side in accordance with an embodiment of the present invention.
Figure 4:
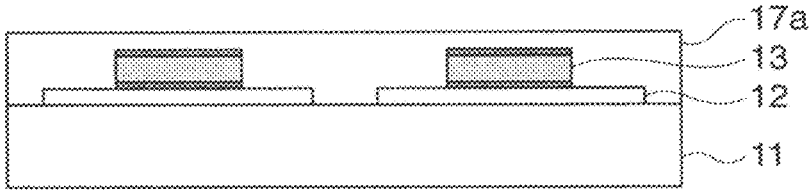
Figure 4:
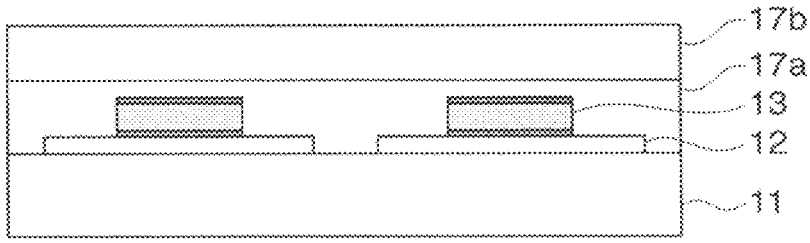

FIGS. 4(*a*) to 4(*c*) are explanatory diagrams that show a second example of the manufacturing method of the substrate on the front face side.

The dielectric layer may be formed by laminating a plurality of dielectric layers. For example, two layers or three layers of the dielectric layers may be formed. In the case when two layers of the dielectric layers are formed, for example, the first dielectric layer is formed with a film thickness of 12 μm or less, and the second dielectric layer may be formed thereon with a film thickness of 13 μm or less.

First, transparent electrodes 12 and bus electrodes 13 are formed on a glass substrate 11 on the front face side by using the same materials as those of the aforementioned first example through the same method (see FIG. 4(*a*)). The display electrodes X and Y are formed with a film thickness of 6 μm or less. The film thickness of the Cu portion of the bus electrode 13 is set in a range from 3 to 4 μm.

In the present example, the dielectric layer is formed through two-layer processes. In other words, a non-lead-based glass paste (softening point: about 600° C.) is applied onto a glass substrate 11 by using a screen printing method, and after this has been dried into a dried film, the glass substrate 11 is loaded into a firing furnace, and the dried film of the glass material is fired at a temperature in a range from 600 to 610° C. so that a first dielectric film 17*a* is formed with a thickness of 5 to 10 μm (see FIG. 4(*b*)). Moreover, a non-lead-based glass paste (softening point: about 550° C.) is applied onto the first dielectric film 17*a* after the firing process by using the screen printing method, and after this has been dried into a dried film, the resulting glass substrate is loaded into a firing furnace, and the dried film of the glass material is fired at a temperature in a range from 550 to 560° C. so that a second dielectric film 17*b* is formed with a thickness of 10 to 15 μm (see FIG. 4(*c*)). The first dielectric layer 17*a* and the second dielectric layer 17*b* are formed so as to have a total thickness of about 20 μm.

At this time, upon firing the first dielectric layer 17*a*, since the first dielectric layer 17*a* is so thin that the first dielectric layer has a superior defoaming property. Moreover, upon firing the second dielectric layer 17*b*, since the second dielectric layer 17*b* is not made in contact with the bus electrodes, no electrochemical reaction takes place between the metal and glass to cause no generation of bubbles in the second dielectric layer. Therefore, it becomes possible to further reduce bubbles in the dielectric layer in comparison with the single-layer structure.

Figures 5, 6:
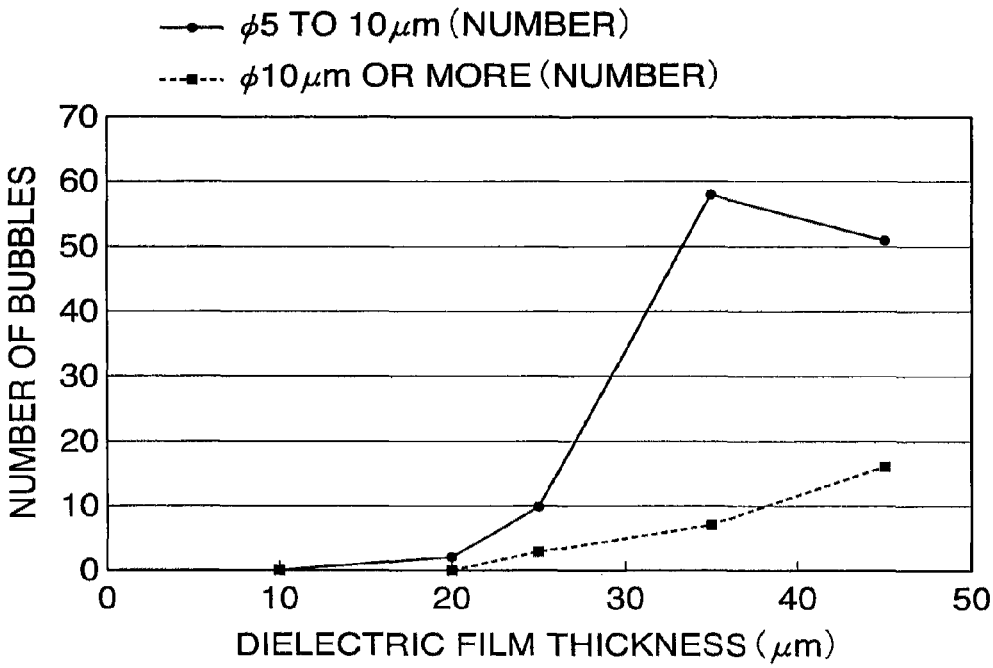
FIG. 5 is a table that indicates relationship between a film thickness of a dielectric layer and the number of bubbles in accordance with an embodiment of the present invention.
FIG. 6 is a graph that indicates the relationship between the film thickness of the dielectric layer and the number of bubbles in accordance with an embodiment of the present invention.

FIG. 5 is a Table indicating the relationship between the film thickness of the dielectric layer and the number of bubbles. FIG. 6 is a graph by which the Table of FIG. 5 is indicated. Here, the film thickness of the dielectric layer is indicated as "dielectric film thickness".

The following results are obtained by these Table and Graph. In other words, a dielectric layer is formed by affixing a green sheet with which non-lead-based glass powder is mixed to a glass substrate on which display electrodes are formed with a thickness of 3 to 4 μm, and by firing the resulting substrate in a range from 600 to 610° C., a dielectric layer is formed so that the dielectric layer after the firing process is allowed to have a film thickness of 20 μm. The Table and Graph indicate the relationship between the film thickness (μm) of the dielectric layer at this time and the number of bubbles (number). In the Graph, the solid line shows the number of bubbles having a size in a range from 5 to 10 μm in diameter, and the dot line shows the number of bubbles having a size of 10 μm or more in diameter.

As indicated by the Table and Graph, the following results are obtained:

(i) When the film thickness of the dielectric layer is 10 μm, the number of bubbles in a range from ϕ5 to 10 μm is "0", and the number of bubbles of ϕ10 μm or more is also "0".

(ii) When the film thickness of the dielectric layer is 20 μm, the number of bubbles in a range from ϕ5 to 10 μm is "2", and the number of bubbles of ϕ10 μm or more is "0".

(iii) When the film thickness of the dielectric layer is 25 μm, the number of bubbles in a range from ϕ5 to 10 μm is "10", and the number of bubbles of ϕ10 μm or more is "3".

(iv) When the film thickness of the dielectric layer is 35 μm, the number of bubbles in a range from ϕ5 to 10 μm is "58", and the number of bubbles of ϕ10 μn or more is "7".

(v) When the film thickness of the dielectric layer is 45 μm, the number of bubbles in a range from ϕ5 to 10 μm is "51", and the number of bubbles of ϕ10 μm or more is "16".

In the case when the display electrodes are formed with a thickness of 3 to 4 μm while the dielectric layer is formed with a film thickness of about 20 μm by using a non-lead-based glass material, it has been confirmed that no bubbles exist in the dielectric layer. When a panel is formed by using this structure, it has been confirmed that no problems such as an insufficient insulation and a reduction in luminescence arise.

As described above, in accordance with the present invention, the thickness of metal electrodes is made thinner (6 μm or less) and the film thickness of the dielectric layer is also made thinner (25 μm or less) so that it becomes possible to eliminate bubbles in the dielectric layer upon completion of the firing process. With this arrangement, even when a non-lead-based glass material is used as the material for the dielectric layer, problems with the panel, such as an insufficient insulation and a reduction in luminescence, can be prevented.

What is claimed is:

1. A method of manufacturing a plasma display panel that includes forming a plurality of metal electrodes on a substrate in a predetermined direction and forming a first and second dielectric layers on the metal electrodes by firing a glass material, the method comprising:

forming the metal electrodes with a film thickness of 4 μm or less, the metal electrodes having a three-layer structure of Cr—Cu—Cr in which a first Cr layer is formed on the substrate, a Cu layer is formed on the first Cr layer, and a second Cr layer is formed on the Cu layer, the Cu layer having a film thickness of 3 μm to 4 μm and each of the first Cr layer and the second Cr layers having a thickness of 500 Å to 2000 Å;

placing a first glass material on the substrate, including the metal electrodes;

firing the first glass material at a temperature of higher than 600 degrees Celsius and lower or equal to 610 degrees Celsius so that the first dielectric layer is formed having a film thickness of 5 μm to 10 μm;

placing a second glass material on the first dielectric layer after the first dielectric layer has been fired; and firing the second glass material at a temperature of 550 degrees Celsius to 560 degrees Celsius so that the second dielectric layer is formed having a film thickness of 10 μm to 15 μm, wherein the first and second dielectric layers are formed with a total film thickness of 20 μm or less by firing a glass paste including a non-lead based glass frit, a binder resin, and a solvent so that bubbles of 10 μm or more in diameter do not exist in the first and second dielectric layers.

2. The method of manufacturing a plasma display panel according to claim 1, wherein the non-lead-based glass frit is constituted from a glass material selected from the group consisting of $B_2O_3$—$SiO_2$—ZnO-based glass, $Bi_2O_3$—$B_2O_3$—$SiO_2$-based glass, $B_2O_3$—$SiO_2$—$Al_2O_3$-based glass, ZnO—$B_2O_3$—$SiO_2$—BaO-based glass, and any of these mixed with an alkali or alkali-earth oxide.

3. The method of manufacturing a plasma display panel according to claim 1, wherein the metal electrodes are formed by a wet-etching process.

4. The plasma display panel according to claim 1, wherein the first dielectric layer has a softening point that is higher than a softening point of the second dielectric layer.

* * * * *

UNITED STATES PATENT AND TRADEMARK OFFICE

CERTIFICATE OF CORRECTION

PATENT NO. : 8,231,422 B2
APPLICATION NO. : 11/714166
DATED : July 31, 2012
INVENTOR(S) : Motonari Kifune et al.

It is certified that error appears in the above-identified patent and that said Letters Patent is hereby corrected as shown below:

Column 9, Line 7 (Approx.), In Claim 1, after "forming" delete "a".

Signed and Sealed this
Sixteenth Day of October, 2012

David J. Kappos

David J. Kappos
*Director of the United States Patent and Trademark Office*